US008157514B2

(12) United States Patent
Reyes et al.

(10) Patent No.: US 8,157,514 B2
(45) Date of Patent: Apr. 17, 2012

(54) COMPONENTS FOR GAS TURBINE ENGINES

(75) Inventors: Victor Reyes, Chandler, AZ (US); Christopher Urwiller, Tempe, AZ (US); Robert Sandoval, Tempe, AZ (US); John Best, Cave Creek, AZ (US)

(73) Assignee: Honeywell International Inc., Morristown, NJ (US)

( * ) Notice: Subject to any disclaimer, the term of this patent is extended or adjusted under 35 U.S.C. 154(b) by 524 days.

(21) Appl. No.: 12/407,534

(22) Filed: Mar. 19, 2009

(65) Prior Publication Data

US 2010/0239422 A1 Sep. 23, 2010

(51) Int. Cl.
*F04D 29/18* (2006.01)

(52) U.S. Cl. ..... 415/199.4; 418/234; 418/237

(58) Field of Classification Search ..... 415/199.4, 415/228; 416/204 A, 234, 237
See application file for complete search history.

(56) References Cited

U.S. PATENT DOCUMENTS 2,623,727 A 12/1952 McLeod
3,817,657 A * 6/1974 Hueber ..... 416/244 R
3,847,506 A 11/1974 Straniti
4,536,932 A 8/1985 Athey
4,685,863 A 8/1987 McLean
4,813,848 A 3/1989 Novotny
7,097,422 B2 8/2006 Rice et al.
7,887,299 B2 * 2/2011 Xiao ..... 416/203
2008/0304974 A1 * 12/2008 Marshall et al. ..... 416/223 R
2011/0182745 A1 * 7/2011 Suciu et al. ..... 416/234

* cited by examiner

*Primary Examiner* — Stephen W Smoot

(74) *Attorney, Agent, or Firm* — Ingrassia Fisher & Lorenz, P.C.

(57) ABSTRACT

A component for a gas turbine engine having an engine axis includes a rotor disk and a plurality of airfoils. The rotor disk comprises a web and a rim. The web has a first outer surface at least partially defining a plurality of holes and a plurality of slots. Each of the plurality of slots extends from a corresponding one of the plurality of holes and forms a first angle with the engine axis at the point of intersection with the corresponding one of the plurality of holes. The rim has a second outer surface also at least partially defining the plurality of slots. Each of the plurality of slots forms a second angle with the engine axis at the second outer surface, the second angle being different from the first angle. Each of the plurality of airfoils extends from the second outer surface.

20 Claims, 5 Drawing Sheets

COMPONENTS FOR GAS TURBINE ENGINES

FIELD OF THE INVENTION

The present invention relates to gas turbine engines and, more particularly, to components for gas turbine engines.

BACKGROUND OF THE INVENTION

A gas turbine engine may be used to power various types of vehicles and systems. One particular type of gas turbine engine that may be used to power aircraft is a turbofan gas turbine engine. A turbofan gas turbine engine may include, for example, five major sections, namely, a fan section, a compressor section, a combustor section, a turbine section, and an exhaust section. Other gas turbine engines may not include a fan section, and thereby may include four major sections, namely, a compressor section, a combustor section, a turbine section, and an exhaust section.

The fan section, if applicable, is positioned at the front, or "inlet" section of the engine, and includes a fan that induces air from the surrounding environment into the engine, and accelerates a fraction of this air toward the compressor section. The remaining fraction of air induced into the fan section is accelerated into and through a bypass plenum, and out the exhaust section. The compressor section raises the pressure of the air it receives from the fan section and/or from another source or inlet to a relatively high level. The compressed air from the compressor section then enters the combustor section, where a ring of fuel nozzles injects a steady stream of fuel. The injected fuel is ignited by a burner, which significantly increases the energy of the compressed air.

The high-energy compressed air from the combustor section then flows into and through the turbine section, causing rotationally mounted turbine blades to rotate and generate energy. Specifically, high-energy compressed air impinges on turbine vanes and turbine blades, causing the turbine to rotate. The air exiting the turbine section is exhausted from the engine via the exhaust section, and the energy remaining in this exhaust air aids the thrust generated by the air flowing through the bypass plenum.

Certain of these gas turbine engine components, such as the fan section (if applicable), the compressor section, and the turbine section, typically include a plurality of rotor blades coupled to a rotor disk that is configured to rotate. Such gas turbine engine components may experience stress from operation of the gas turbine engine, such as when portions of the component experience a significantly different range of temperatures from one another.

Accordingly, there is a need for an improved gas turbine engine and/or turbine engine component with a mechanism to help alleviate stress during operation. Furthermore, other desirable features and characteristics of the present invention will become apparent from the subsequent detailed description of the invention and the appended claims, taken in conjunction with the accompanying drawings and this background of the invention.

SUMMARY OF THE INVENTION

In accordance with an exemplary embodiment of the present invention, a component for a gas turbine engine having an engine axis is provided. The component comprises a rotor disk and a plurality of airfoils. The rotor disk comprises a web and a rim. The web has a first outer surface at least partially defining a plurality of holes and a plurality of slots.

Each of the plurality of slots extends from a corresponding one of the plurality of holes and forms a first angle with the engine axis at the point of intersection with the corresponding one of the plurality of holes. The rim has a second outer surface also at least partially defining the plurality of slots. Each of the plurality of slots forms a second angle with the engine axis at the second outer surface, the second angle being different from the first angle. Each of the plurality of airfoils extends from the second outer surface.

In accordance with another exemplary embodiment of the present invention, a turbine section for a gas turbine engine having an engine axis is provided. The turbine section comprises a rotor disk and a plurality of turbine blades. The rotor disk comprises a web and a rim. The web has a first outer surface at least partially defining a plurality of holes and a plurality of slots. Each of the plurality of slots extends from a corresponding one of the plurality of holes and forms a first angle with the engine axis at the point of intersection with the corresponding one of the plurality of holes. The rim has a second outer surface also at least partially defining the plurality of slots. Each of the plurality of slots forms a second angle with the engine axis at the second outer surface, the second angle being different from the first angle. Each of the plurality of turbine blades extends from the second outer surface.

In accordance with another exemplary embodiment of the present invention, a gas turbine engine is provided. The gas turbine engine has an engine axis, and comprises a compressor, a combustor, and a turbine. The compressor has an inlet and an outlet. The compressor is operable to receive accelerated air through the inlet, compress the accelerated air, and supply the compressed air through the outlet. The combustor is coupled to receive at least a portion of the compressed air from the compressor outlet, and is operable to supply combusted air. The turbine is coupled to receive the combusted air from the combustor and at least a portion of the compressed air from the compressor and to generate energy therefrom. The turbine comprises a rotor disk and a plurality of turbine blades. The rotor disk comprises a web and a rim. The web has a first outer surface at least partially defining a plurality of holes and a plurality of slots. Each of the plurality of slots extends from a corresponding one of the plurality of holes and forms a first angle with the engine axis at the point of intersection with the corresponding one of the plurality of holes. The rim has a second outer surface also at least partially defining the plurality of slots. Each of the plurality of slots forms a second angle with the engine axis at the second outer surface, the second angle being different from the first angle. Each of the plurality of turbine blades extends from the second outer surface.

DETAILED DESCRIPTION OF A PREFERRED EMBODIMENT

Before proceeding with the detailed description, it is to be appreciated that the described embodiment is not limited to use in conjunction with a particular type of turbine engine or in a particular section or portion of a gas turbine engine. Thus, although the present embodiment is, for convenience of explanation, depicted and described as being implemented in a turbine section of a turbofan gas turbine jet engine, it will be appreciated that it can be implemented in various other sections and in various types of engines.

Figure 1:
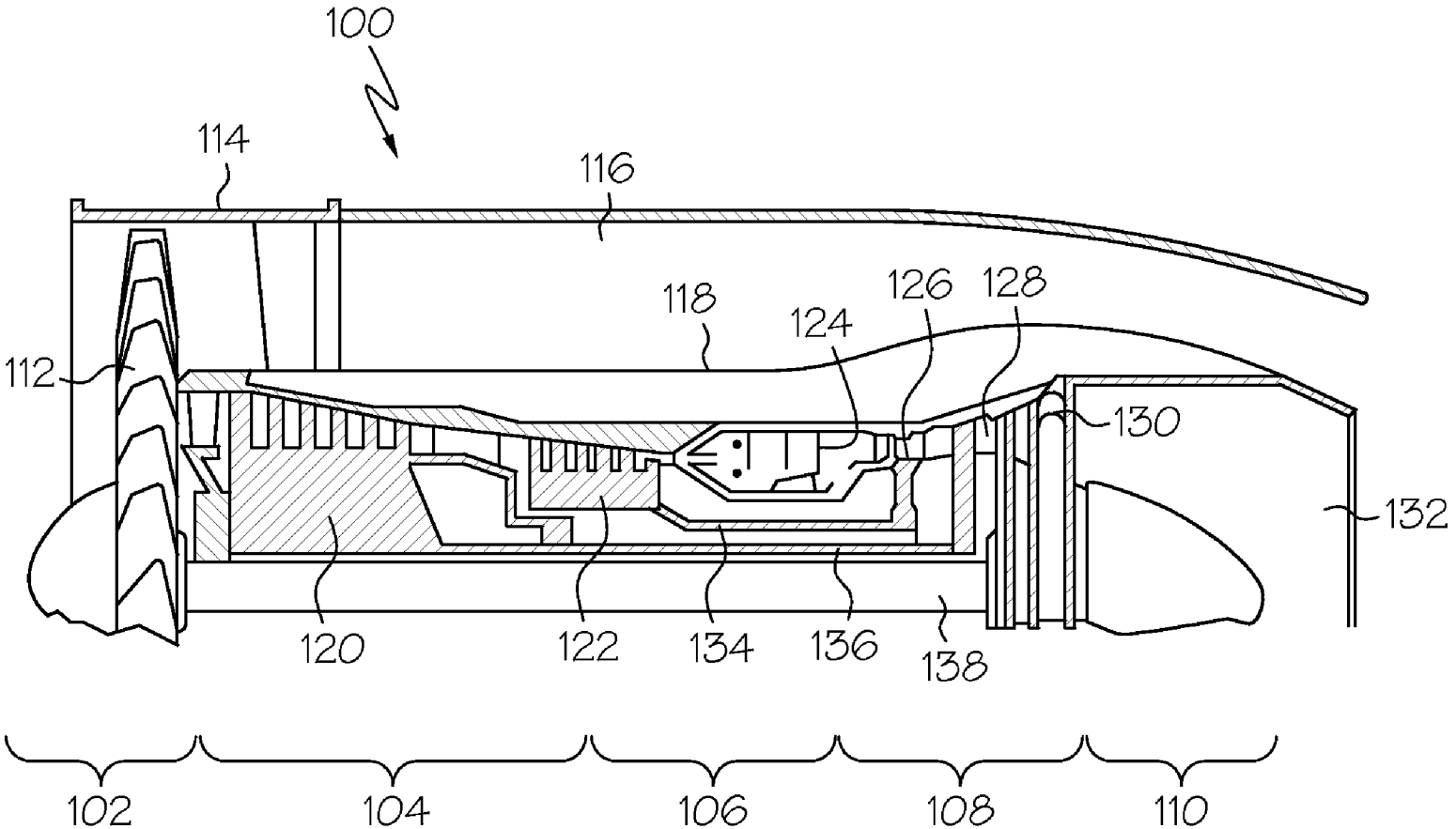
FIG. 1 is a simplified cross section side view of an exemplary multi-spool turbofan gas turbine jet engine according to an embodiment of the present invention, in accordance with an exemplary embodiment of the present invention.

An exemplary embodiment of a gas turbine jet engine 100 is depicted in FIG. 1, and includes an intake section 102, a compressor section 104, a combustion section 106, a turbine section 108, and an exhaust section 110. In the depicted embodiment, the intake section 102 includes a fan 112, which is mounted in a fan case 114. The fan 112 draws air into the intake section 102 and accelerates it. A fraction of the accelerated air exhausted from the fan 112 is directed through a bypass section 116 disposed between the fan case 114 and an engine cowl 118, and provides a forward thrust. The remaining fraction of air exhausted from the fan 112 is directed into the compressor section 104.

While the gas turbine engine 100 is depicted in FIG. 1 as a turbofan gas turbine engine, this may vary in other embodiments. For example, the gas turbine engine 100 may not include a fan section in certain embodiments. In addition, in various other embodiments, the gas turbine engine 100 may otherwise differ from that depicted in FIG. 1 with one or more other different features or characteristics.

The compressor section 104 includes one or more compressors. In the depicted embodiment, the compressor section 104 includes two compressors, an intermediate pressure compressor 120, and a high pressure compressor 122. However, the number of compressors may vary in other embodiments. The intermediate pressure compressor 120 raises the pressure of the air directed into it from the fan 112, and directs the compressed air into the high pressure compressor 122. The high pressure compressor 122 compresses the air still further, and directs a majority of the high pressure air into the combustion section 106. In addition, a fraction of the compressed air bypasses the combustion section 106 and is used to cool, among other components, turbine blades in the turbine section 108. In the combustion section 106, which includes an annular combustor 124, the high pressure air is mixed with fuel and combusted. The high-temperature combusted air is then directed into the turbine section 108.

The turbine section 108 includes one or more turbines. In the depicted embodiment, the turbine section 108 includes three turbines disposed in axial flow series, a high pressure turbine 126, an intermediate pressure turbine 128, and a low pressure turbine 130. However, it will be appreciated that the number of turbines, and/or the configurations thereof, may vary, as may the number and/or configurations of various other components of the exemplary gas turbine engine 100. The high-temperature combusted air from the combustion section 106 expands through each turbine, causing it to rotate. The air is then exhausted through a propulsion nozzle 132 disposed in the exhaust section 110, providing addition forward thrust. As the turbines rotate, each drives equipment in the gas turbine engine 100 via concentrically disposed shafts or spools. Specifically, the high pressure turbine 126 drives the high pressure compressor 122 via a high pressure spool 134, the intermediate pressure turbine 128 drives the intermediate pressure compressor 120 via an intermediate pressure spool 136, and the low pressure turbine 130 drives the fan 112 via a low pressure spool 138. As mentioned above, the gas turbine engine 100 of FIG. 1 is merely exemplary in nature, and can vary in different embodiments.

Figure 2:
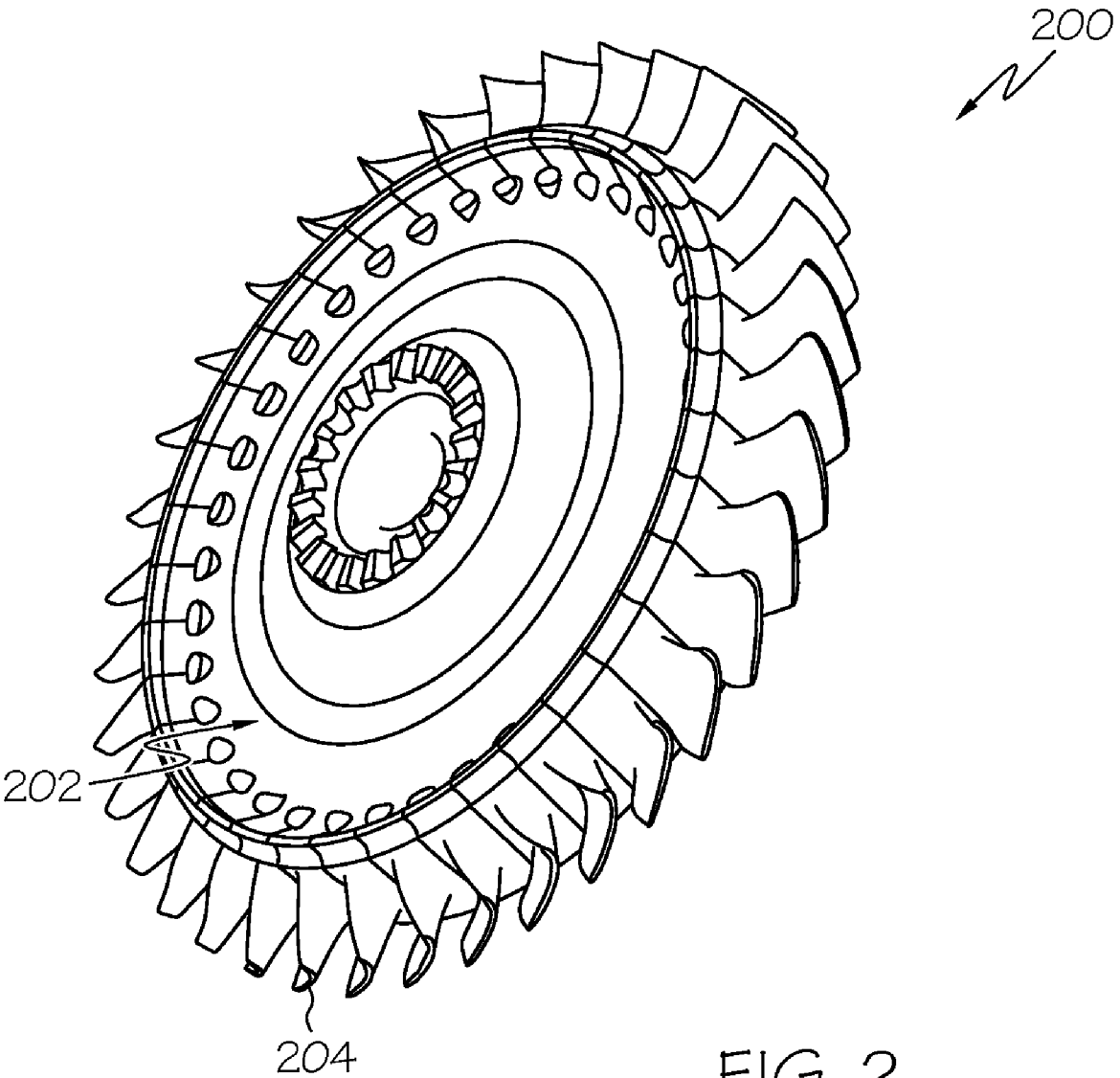
FIG. 2 is a perspective plan view of a rotor component that may be used in an engine, such as the exemplary engine of FIG. 1, in accordance with an exemplary embodiment of the present invention.
Figure 4:
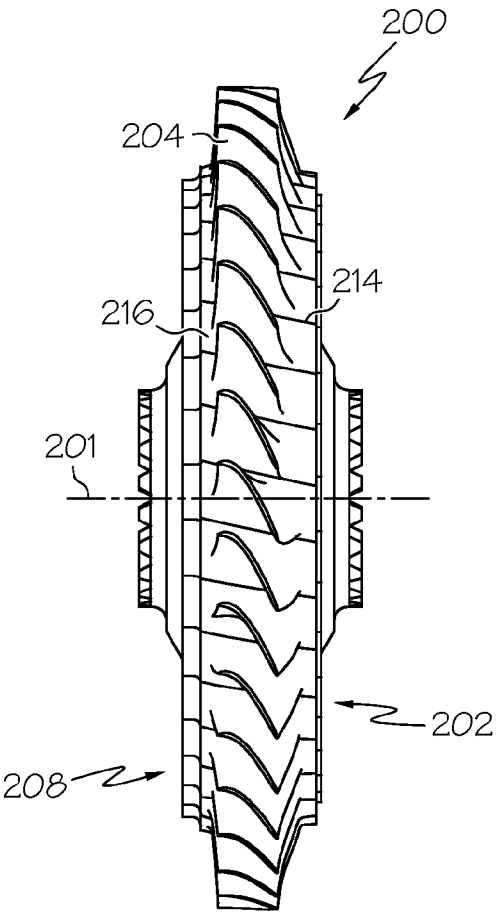
FIG. 4 is a plan view of the rotor component of FIG. 2, shown from a side view, in accordance with an exemplary embodiment of the present invention.
Figure 3:
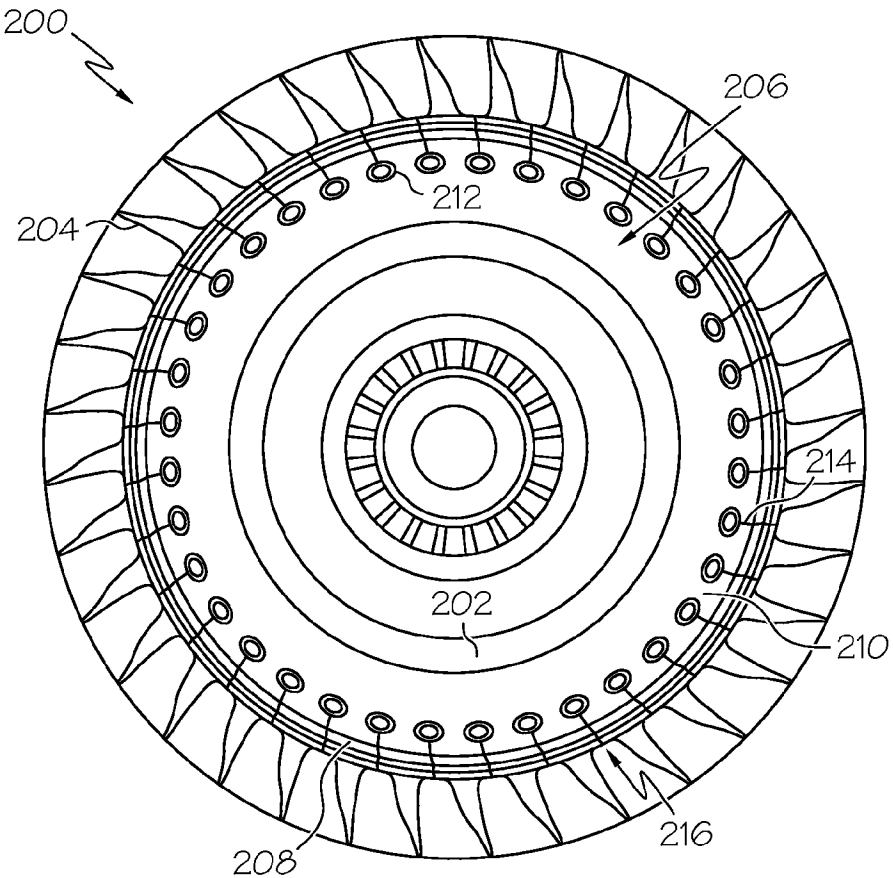
FIG. 3 is a plan view of the rotor component of FIG. 2, shown from a front view, in accordance with an exemplary embodiment of the present invention.
Figure 6:
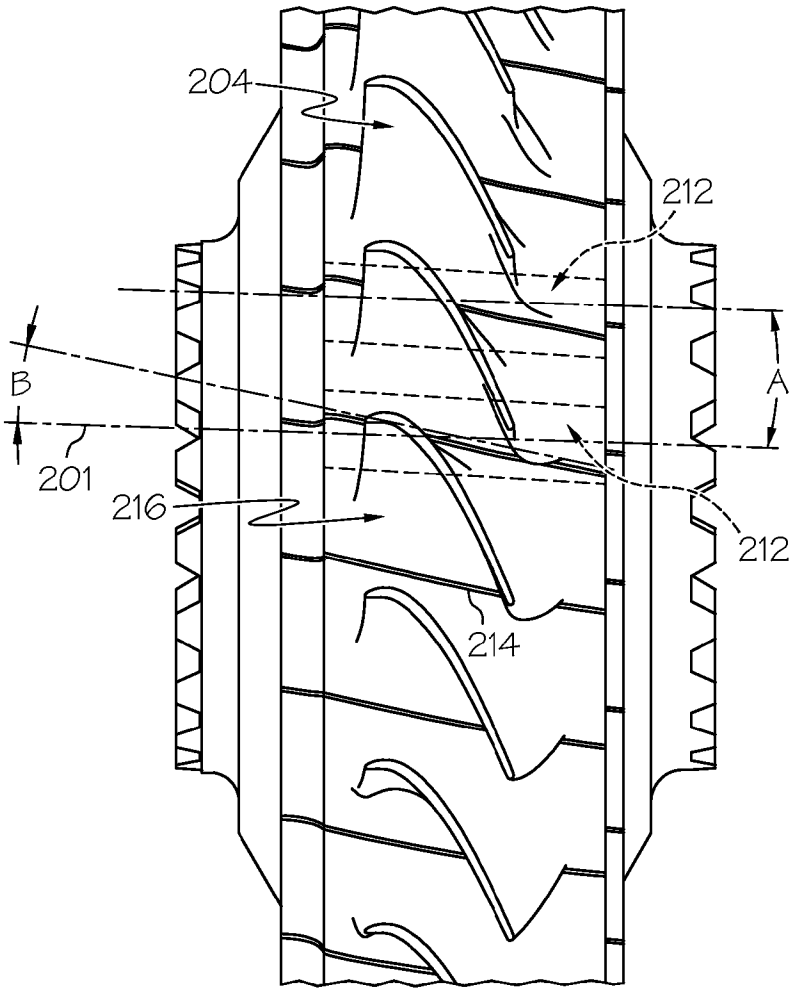
FIG. 6 is a close-up plan view of a portion of the rotor component of FIG. 2, shown from a top view, in accordance with an exemplary embodiment of the present invention.
Figure 5:
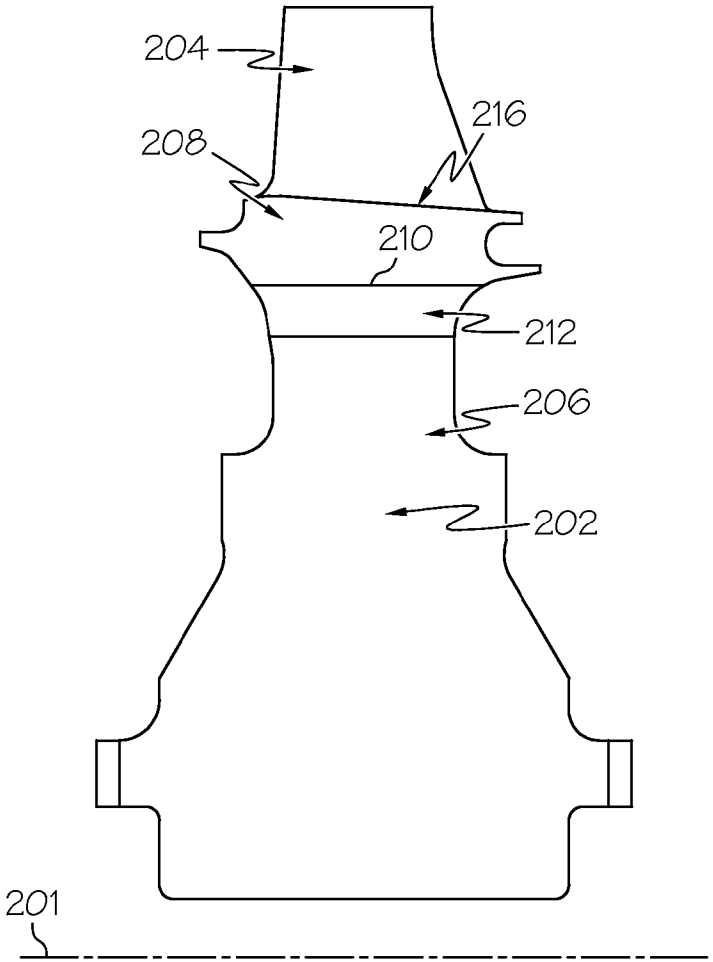
FIG. 5 is a plan view of a portion of the rotor component of FIG. 2, shown from a side view, in accordance with an exemplary embodiment of the present invention.
Figure 7:
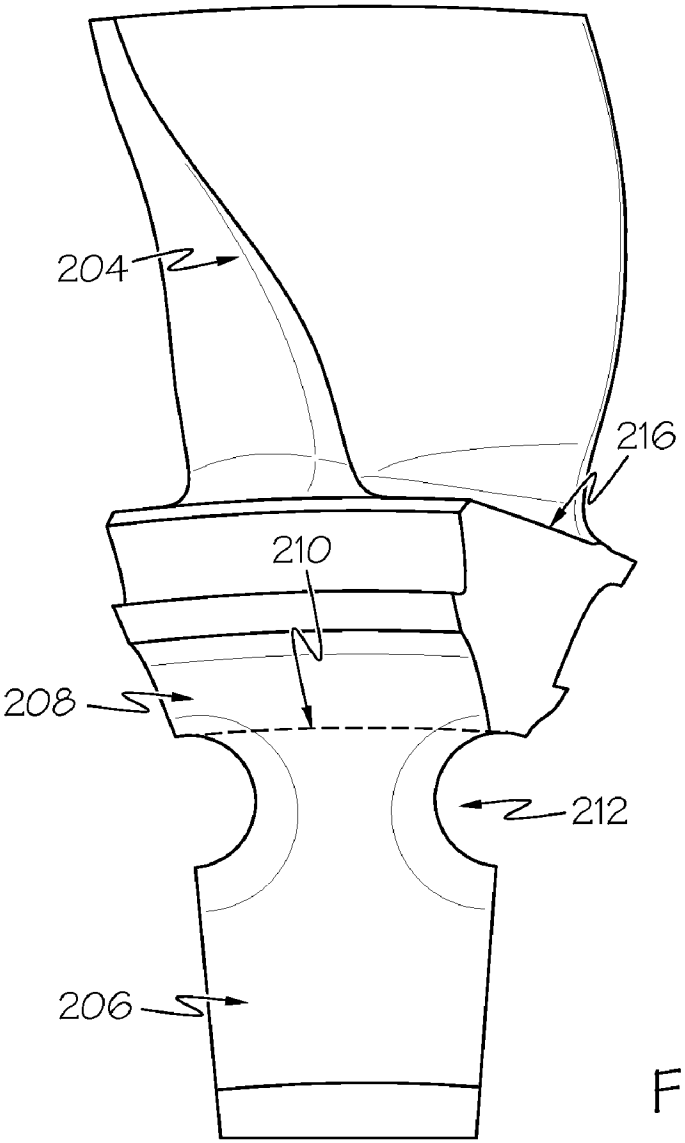
FIG. 7 is a close-up plan view of a portion of the rotor component of FIG. 2, shown from a view along the engine axis, in accordance with an exemplary embodiment of the present invention.

FIGS. 2-7 depict, from various views, a rotor component 200 that may be used in an engine, such as the exemplary gas turbine engine 100 of FIG. 1. Specifically, (i) FIG. 2 provides a perspective view of the rotor component 200; (ii) FIG. 3 provides a front view of the rotor component 200; (iii) FIG. 4 provides a side view of the rotor component 200; (iv) FIG. 5 provides a side view of a portion of the rotor component 200 isolated for clarity, (v) FIG. 6 provides a close-up plan view of a portion of the rotor component of FIG. 2, shown from a top view; and (vi) FIG. 7 provides a close-up view along the engine axis of a portion of the rotor component 200 for additional clarity, all in accordance with an exemplary embodiment of the present invention. The rotor component 200 can be used in one or more above-described engine components, including, among others, one or more turbines of the turbine section 108 of FIG. 1, one or more compressors of the compressor section 104 of FIG. 1, the fan 112 of FIG. 1, and/or in various other components of various other different types of engines and/or other devices.

The rotor component 200 is depicted in FIGS. 2-7 with reference to an engine axis 201 of the engine, such as the gas turbine engine 100 of FIG. 1. The rotor component 200 includes a rotor disk 202 and a plurality of airfoils 204. In one exemplary embodiment, the airfoils 204 are formed integral with the rotor disk 202. However, this may vary in other embodiments.

As depicted in FIGS. 2-7, the rotor disk 202 includes a web 206 and a rim 208. In one exemplary embodiment, the web 206 and the rim 208 are formed integral with one another. However, this may vary in other embodiments. In another exemplary embodiment, the web 206 and the rim 208 are dual alloy in nature. For example, in one such exemplary embodiment, the rim 208 is made of a relatively higher heat resistant material to help withstand high temperatures from the flow path of the engine, while the web 206 is made of a relatively higher strength material for improved longevity of use. However, this may also vary in other embodiments.

The web 206 has a first outer surface 210 depicted in FIGS. 2-7. The first outer surface 210 at least partially defines a plurality of holes 212 and a plurality of slots 214. The slots 214 provide stress relief for the rotor component, for example when temperatures from the web 206 and the rim 208 differ significantly from one another during operation of the engine. The holes 212 provide further stress relief, and help to prevent the slots 214 from propagating beyond a desired magnitude and/or direction. Each of the plurality of slots 214 extends from a corresponding one of the plurality of holes 212 within the web 206 and extends therefrom toward the rim 208. In addition, each of the plurality of slots 214 forms a first angle A with respect to engine axis 201 at the point of intersection with the corresponding one of the plurality of holes 212. In a preferred embodiment, the first angle A is at least approximately equal to zero. However, the first angle A may vary in other embodiments. Also in a preferred embodiment, each of the holes 212 is at least substantially parallel to the engine axis 201. However, the holes 212 are not necessarily parallel to the engine axis 201 in all embodiments.

The rim 208 has a second outer surface 216. The second outer surface 216 also at least partially defines the plurality of slots 214, such that each of the plurality of slots 214 forms a second angle B with respect to the engine axis 201 at the second outer surface 216. In a preferred embodiment, the second angle B is different from the first angle. Most preferably, the second angle B is greater than the first angle. For example, in one exemplary embodiment in which the first angle A is equal to zero, the second angle B is equal to fifteen degrees. However, this may vary in other embodiments.

Accordingly, and as depicted in FIGS. 2-7, each of the slots 214 preferably extends from and through a portion of the second outer surface 216 of the rim 208 and to and through a portion of the first outer surface 210 of the web 206, toward a corresponding hole 212 and until the slot 214 reaches and intersects with the corresponding hole 212. Each slot 214 preferably gradually curves, twists, or rotates along the way so that the second angle B that the slot 214 makes with the engine axis 201 at the rim 208 is different from the first angle A that the slot 214 makes with the engine axis 201 at the point of intersection of the slot 214 with the corresponding hole 212 in the web 206.

In a preferred embodiment, the second angle B is at least approximately equal to the angle between a line formed by the tangency points of the airfoil 204 leading and trailing edges at the second outer surface 216 and the engine axis 201 (commonly referenced in the field as the stagger angle), so that each of the slots 214 is at least approximately parallel to the flow path at the rim 208 and the second outer surface 216 thereof. Also in a preferred embodiment, each of the slots 214 is aligned with and parallel to its corresponding hole 212 at the point of intersection of each slot 214 with its corresponding hole 212, such that each of the slots 214 and their corresponding holes 212 are aligned not only with one another but also with the engine axis 201 (and preferably with the first angle A being at least approximately equal to zero, as discussed above).

The angular rotation of the slots 214 and the alignment of the holes 212 and slots 214 with one another and the engine axis 201 provide for improved performance and/or durability of the rotor component 200 and/or for the engine with which the rotor component 200 is utilized. First, the slots 214 provide optimal stress relief from the flow path due to the alignment of the slots 214 with the flow path at the rim 208. Also, the slots 214 provide for optimal durability due to the alignment of the holes 212 with the engine axis 201 and the alignment of the slots 214 with the engine axis 201 at the points in with each of the slots 214 intersects with its corresponding hole 212. Accordingly, these features provide for a reduction in peaking of stresses in edges of each of the holes 212. In addition, this reduction in stress increases the fatigue capability of the rotor component 200, thereby also allowing for the use of an integral dual alloy or cast turbine rotor component 200 to be used if desired.

In the depicted embodiment, each of the plurality of airfoils 204 extends from the second outer surface 216 of the rim 208 in a direction that is generally radially outward from the web 206. In the depicted embodiment, each of the plurality of airfoils 204 extends from a portion of the second outer surface 216 of the rim 208 between two corresponding slots 214 surrounding the portion of the second outer surface 216. Thus, in the depicted embodiment, the second outer surface 216 of the rim 208 alternates between airfoils 204 and slots 214 that extend in generally opposite directions around the perimeter of the rotor disk 202 as shown in FIGS. 2-7. However, this may vary in other embodiment.

In one preferred embodiment, each of the airfoils 204 comprises a turbine blade, and the rotor component 200 is configured for use in one or more turbines of an engine, such as one or more turbines of the turbine section 108 of the gas turbine engine 100 of FIG. 1. In another embodiment, each of the airfoils 204 comprises a compressor blade, and the rotor component 200 is configured for use in one or more compressors of an engine, such as one or more compressors of the compressor section 104 of the gas turbine engine 100 of FIG. 1. In yet another embodiment, each of the airfoils 204 comprises a fan blade, and the rotor component 200 is configured for use in one or more fans of an engine, such as the fan 112 of the gas turbine engine 100 of FIG. 1. In still other embodiments, the airfoils 204 may take any one or more of a number of different forms, and the rotor component 200 may be implemented in connection with any one or more components or sections of any number of different types of engines.

Accordingly, improved rotor components 200 are provided for use in a turbine section, a compressor section, a fan section, and/or another rotor section of a gas turbine engine. The improved rotor components provide for an improved combination of stress relief and durability as a result of the unique angular rotation of the slots 214 and the alignment of the holes 212 and slots 214 with one another and the engine axis 201. Also, improved gas turbine engines 100 are provided with such improved rotor components 200. Accordingly, as noted above, these features provide for a reduction in peaking of stresses in edges of each of the holes 212. In addition, and also as noted above, this reduction in stress increases the fatigue capability of the rotor component 200, thereby also allowing for the use of an integral dual alloy or cast turbine rotor component 200 to be used if desired.

It will be appreciated that the rotor components 200 and engines 100 may differ from those depicted in the Figures and described herein in connection therewith. It will further be appreciated that the rotor components 200 may be implemented in connection with any number of different sections of any number of different types of engines.

While the invention has been described with reference to a preferred embodiment, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A component for a gas turbine engine having an engine axis, the component comprising:

a rotor disk comprising:

a web having a first outer surface at least partially defining a plurality of holes and a plurality of slots, each of the plurality of slots extending from a corresponding one of the plurality of holes and forming a first angle with the engine axis at the point of intersection with the corresponding one of the plurality of holes; and a rim having a second outer surface at least partially defining the plurality of slots, each of the plurality of slots forming a second angle with the engine axis at the second outer surface, the second angle being different from the first angle; and a plurality of airfoils extending from the second outer surface.

2. The component of claim 1, wherein the first angle is smaller than the second angle.

3. The component of claim 1, wherein the first angle is at least approximately equal to zero.

4. The component of claim 3, wherein the second angle is approximately equal to fifteen degrees.

5. The component of claim 1, wherein each of the plurality of holes is at least approximately parallel to the engine axis.

6. The component of claim 1, wherein each of the plurality of airfoils extends from a portion of the second outer surface between two corresponding slots surrounding the portion of the second outer surface.

7. The component of claim 1, wherein the component is configured to be implemented in a turbine section of the gas turbine engine.

8. The component of claim 1, wherein the component is configured to be implemented in a compressor turbine section of the gas turbine engine.

9. The component of claim 1, wherein the component is configured to be implemented in a fan section of the gas turbine engine.

10. A turbine section for a gas turbine engine having an engine axis, the turbine section comprising:

a rotor disk comprising:

a web having a first outer surface at least partially defining a plurality of holes and a plurality of slots, each of the plurality of slots extending from a corresponding one of the plurality of holes and forming a first angle with the engine axis at the point of intersection with the corresponding one of the plurality of holes; and a rim having a second outer surface at least partially defining the plurality of slots, each of the plurality of slots forming a second angle with the engine axis at the second outer surface, the second angle being different from the first angle; and a plurality of turbine blades extending from the second outer surface.

11. The turbine section of claim 10, wherein the first angle is smaller than the second angle.

12. The turbine section of claim 10, wherein the first angle is at least approximately equal to zero.

13. The turbine section of claim 12, wherein the second angle is approximately equal to fifteen degrees.

14. The turbine section of claim 10, wherein each of the plurality of holes is at least approximately parallel to the engine axis.

15. The turbine section of claim 10, wherein each of the plurality of turbine blades extends from a portion of the second outer surface between two corresponding slots surrounding the portion of the second outer surface.

16. A gas turbine engine having an engine axis, the gas turbine engine comprising:

a compressor having an inlet and an outlet and operable to receive accelerated air through the inlet, compress the accelerated air, and supply the compressed air through the outlet;

a combustor coupled to receive at least a portion of the compressed air from the compressor outlet and operable to supply combusted air;

a turbine coupled to receive the combusted air from the combustor and at least a portion of the compressed air from the compressor and to generate energy therefrom, the turbine comprising:

a rotor disk comprising:

a web having a first outer surface at least partially defining a plurality of holes and a plurality of slots, each of the plurality of slots extending from a corresponding one of the plurality of holes and forming a first angle with the engine axis at the point of intersection with the corresponding one of the plurality of holes; and a rim having a second outer surface at least partially defining the plurality of slots, each of the plurality of slots forming a second angle with the engine axis at the second outer surface, the second angle being different from the first angle; and a plurality of turbine blades extending from the second outer surface.

17. The gas turbine engine of claim 16, wherein the first angle is smaller than the second angle.

18. The gas turbine engine of claim 16, wherein the first angle is at least approximately equal to zero.

19. The gas turbine engine of claim 18, wherein the second angle is approximately equal to fifteen degrees.

20. The gas turbine engine of claim 16, wherein each of the plurality of holes is at least approximately parallel to the engine axis.

* * * * *